United States Patent [19]

Gilpatrick

[11] Patent Number: 5,016,328

[45] Date of Patent: May 21, 1991

[54] CARPET PATTERNING MACHINE AND METHOD

[75] Inventor: Michael W. Gilpatrick, Chesnee, S.C.

[73] Assignee: Milliken Research Corporation, Spartanburg, S.C.

[21] Appl. No.: 506,105

[22] Filed: Apr. 9, 1990

[51] Int. Cl.[5] ..... D06C 13/00

[52] U.S. Cl. ..... 26/7; 26/8 C; 26/69 R; 26/69 C

[58] Field of Search ..... 26/7, 8 C, 69 R, 69 C

[56] References Cited

U.S. PATENT DOCUMENTS

| | | | |
|---|---|---|---|
| 1,450,011 | 3/1923 | Wagner | 26/8 C |
| 3,184,367 | 5/1965 | White | 26/69 R |
| 4,316,400 | 2/1982 | Mayo | 83/425.2 |
| 4,367,998 | 1/1983 | Causer | 414/4 |
| 4,461,082 | 7/1984 | Nissman | 33/25 B |
| 4,467,684 | 8/1984 | Thorsell | 83/404.1 |
| 4,546,546 | 10/1985 | Kleger et al. | 30/273 |
| 4,554,740 | 11/1985 | Gill | 33/25 R |
| 4,561,814 | 12/1985 | Dahlgren, Jr. et al. | 409/80 |
| 4,572,441 | 2/1986 | Sangati | 241/34 |
| 4,606,127 | 8/1986 | Task et al. | 33/1 |
| 4,624,609 | 11/1986 | Pickett | 409/96 |
| 4,657,448 | 4/1987 | Alexander | 409/81 |
| 4,659,278 | 4/1987 | Doege et al. | 414/680 |
| 4,662,073 | 5/1987 | Prusman | 33/27.11 |
| 4,736,486 | 4/1988 | Beneteau et al. | 15/250.23 |
| 4,756,655 | 7/1988 | Jameson | 414/2 |
| 4,817,222 | 4/1989 | Shafir | 12/146 L |
| 4,863,318 | 9/1989 | Pearl | 409/89 |

*Primary Examiner*—Werner H. Schroeder
*Assistant Examiner*—John J. Calvert
*Attorney, Agent, or Firm*—Earle R. Marden; H. William Petry

[57] ABSTRACT

Apparatus and method to sculpture a pile fabric from a predetermined pattern by controlling the movement of the cutter by a pantograph system which employs rotary mounted carriers. The cutter arrangement employs an arrangement where the individual pile fibers or looks are bent over and then individually released so that the rotating cutter blade can sever the fiber or loop against a fixed blade to provide a clean cut of the top of the fiber or fiber loop.

8 Claims, 4 Drawing Sheets

FIG. —1—

CARPET PATTERNING MACHINE AND METHOD

This invention relates generally to the sculpturing of pile fabrics and in particular to the method and apparatus to sculpture pile carpets and carpet tiles.

In the past pile fabrics have been sculptured in many ways such as shrinking of selected fibers chemically or by heat, applying a high velocity water stream to permanently dislodge the carpet fibers, producing areas of high and low pile during production thereof, selectively cutting areas of the pile surface, etc. but none of these methods provides the desired permanent, clear pattern definition desired.

Therefore, it is an object of the invention to provide a method and apparatus to cut the surface of a pile fabric which provides a permanent, sharp pattern in the surface thereof.

Other objects and advantages of the invention will become clearly apparent as the specification proceeds to describe the invention with reference to the accompanying drawings, in which.

Figure 1:
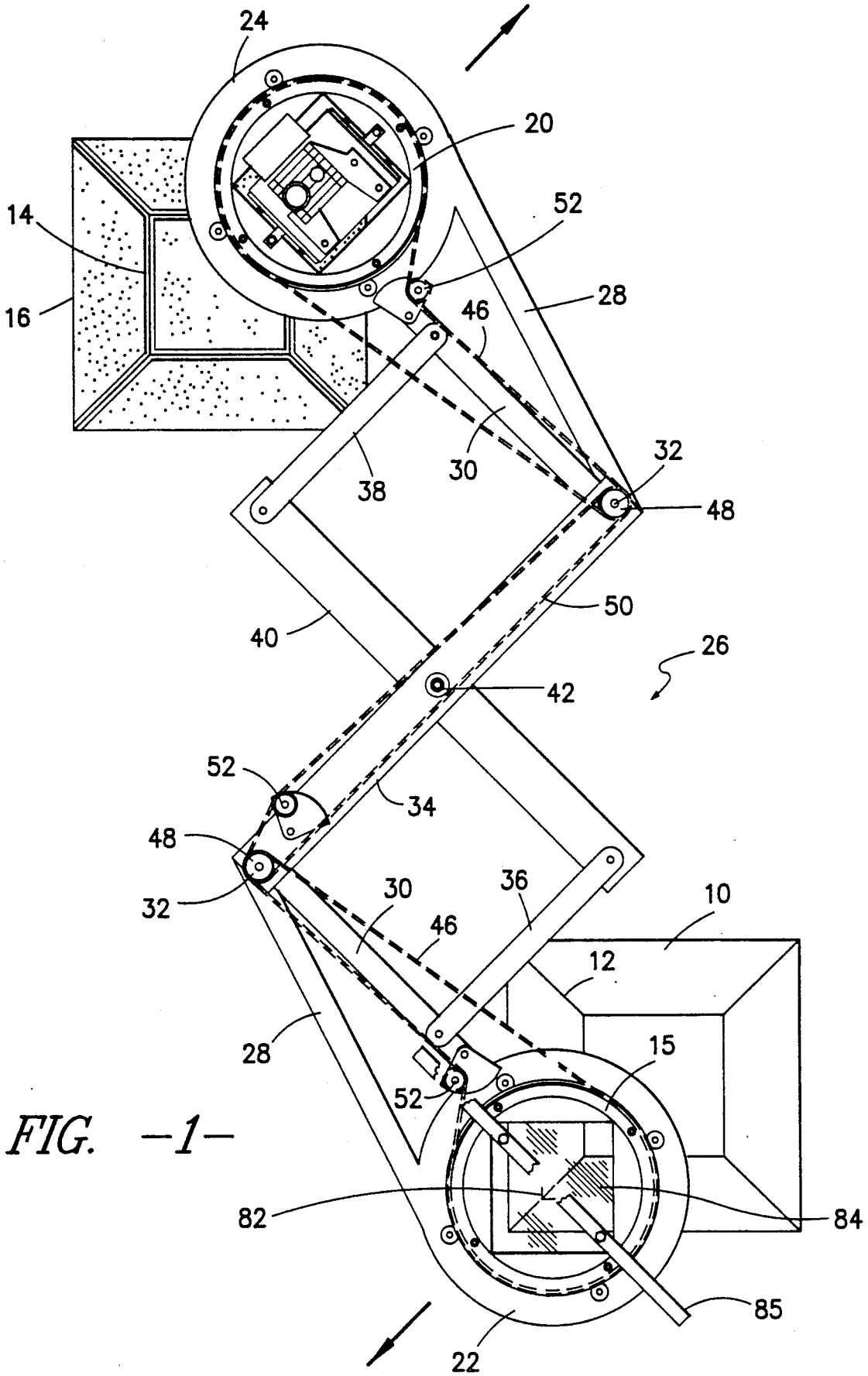
FIG. 1 is a top view of the pattern sculpturing apparatus.

Looking now to FIG. 1 the overall apparatus is shown with the pattern plate 10 with the pattern 12 thereon being followed by the carrier 15 to cut the pattern 14 in the carpet tile 16 with the double edge milling blade 18 in the carrier 20. The carriers 15 and 20 are rotatably mounted in the supports 22 and 24, respectively, and are guided by the pantograph, generally designated 26, located therebetween. Each of the supports has a pair of arms 28 and 30 connected together at a pivot point 32 whereat they are pivotally secured between upper and lower rectangular bars 34.

The pantograph basically consists of parallel bars or linkages 36 and 38 pivotally connected at one end to the parallel arm 30 and at the other end to rectangular bar 40 which is pivotally connected to bars 34 at 42. The basic concept of the pantograph is not, per se, new but in combination with the rotating carriers 15 and 20 provide a flexibility to the apparatus in that it provides a third degree of freedom of the carriers.

Figure 2:
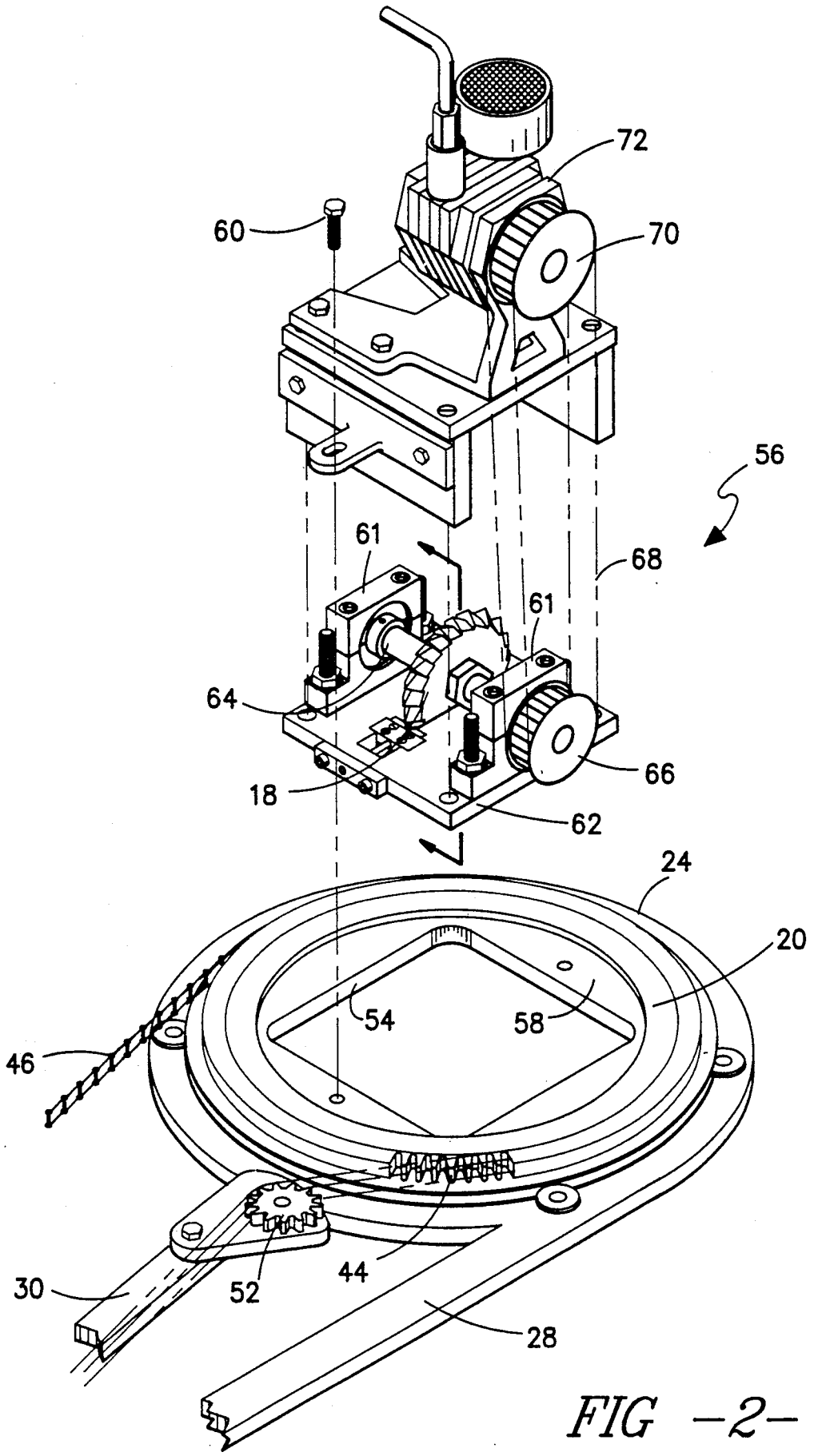
FIG. 2 is an exploded perspective view of the specific cutting apparatus.
Figure 4:
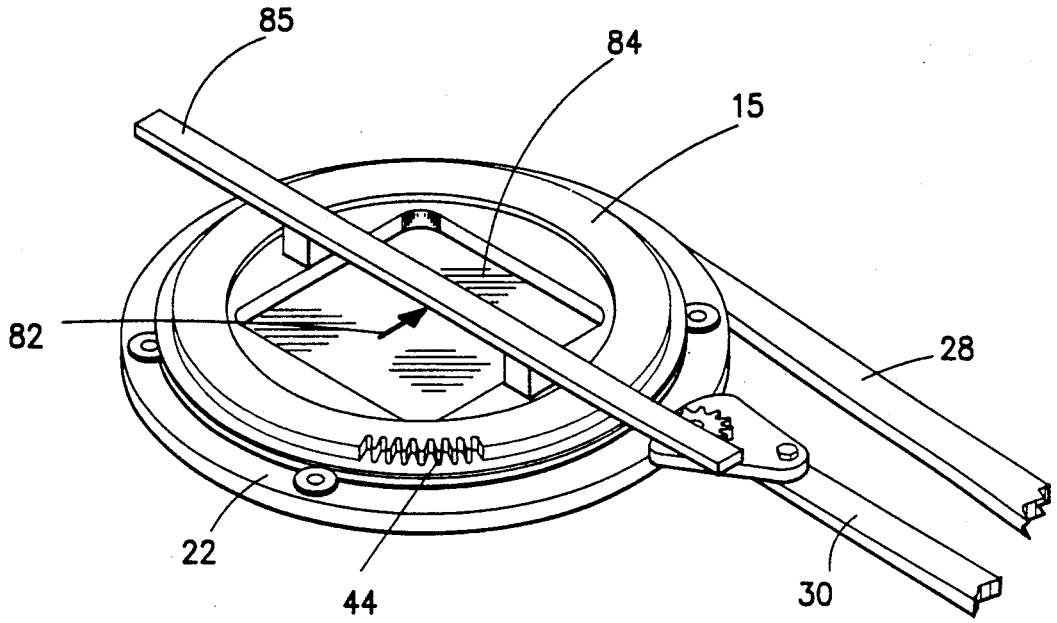
FIG. 4 is a perspective view of the pattern tracing apparatus.

As indicated in FIGS. 2 and 4, the outer periphery of the carriers 15 and 20 have a plurality of teeth 44 which engage a timing chain or belt 46. Rotatably mounted at both ends of the bars 34 are double pulleys 48 around which the timing chain passes. Also engaging the pulleys 48 is a belt or chain 50 which transmits the rotation of the carrier 15 to the carrier 20 through the timing belts or chains 46. Rotation of the carrier 15 in a clockwise or counter-clockwise direction rotates the carrier 20 in the same direction. To adjust the tension in the chains or belts 46 or 50 an adjustable gear or pulley 52 is mounted in engagement with the respective belt or chain and can be moved to adjust the tension in the belt that is engaging same.

To cut the pattern 14 in the carpet 10, a cutting unit 56 containing a motor driven double angled milling blade 18 is mounted in opening 54 of the carrier 20 by securing the cutting unit 56 on top of the plate 58 by means of suitable screws 60 so that the cutting blade 18 projects through the opening 54 into contact with the pile fabric 16 thereunder. The cutting blade 18 is rotatably mounted in suitable bearings 61 on the plate 62 with a shaft 64 projecting outwardly therefrom the support a pulley 66 which is driven by a timing belt 68 connected to the pulley 70 which is driven by the air motor 72. It is understood that other cutting blades of a different configuration can be used but the preferred blade 18 is a double angled milling blade.

Figure 3:
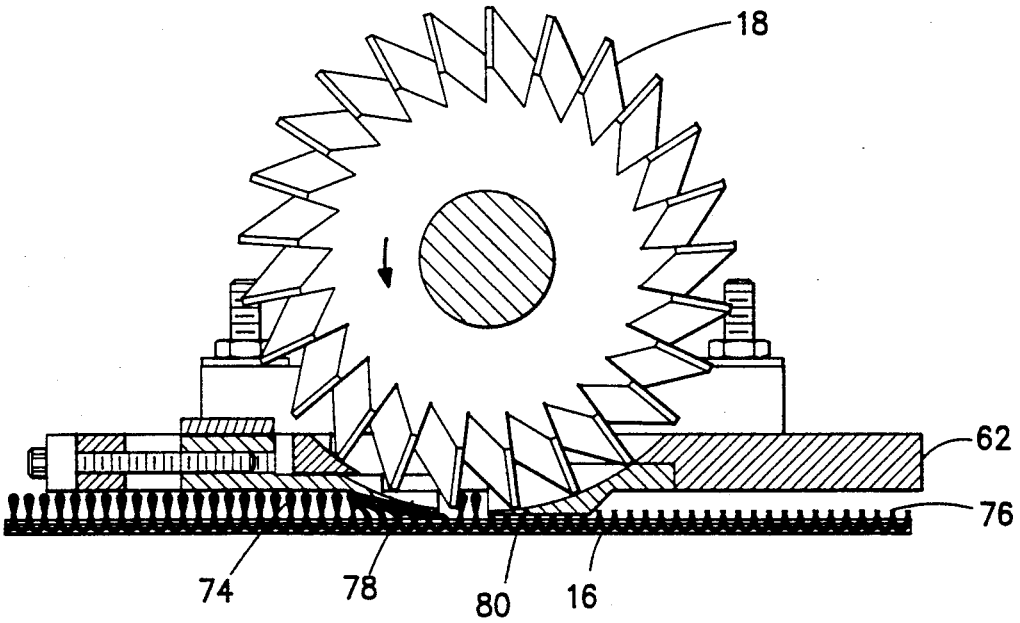
FIG. 3 is a sectional view showing the relationship of the cutting blade to the product being sculptured.
Figure 5:
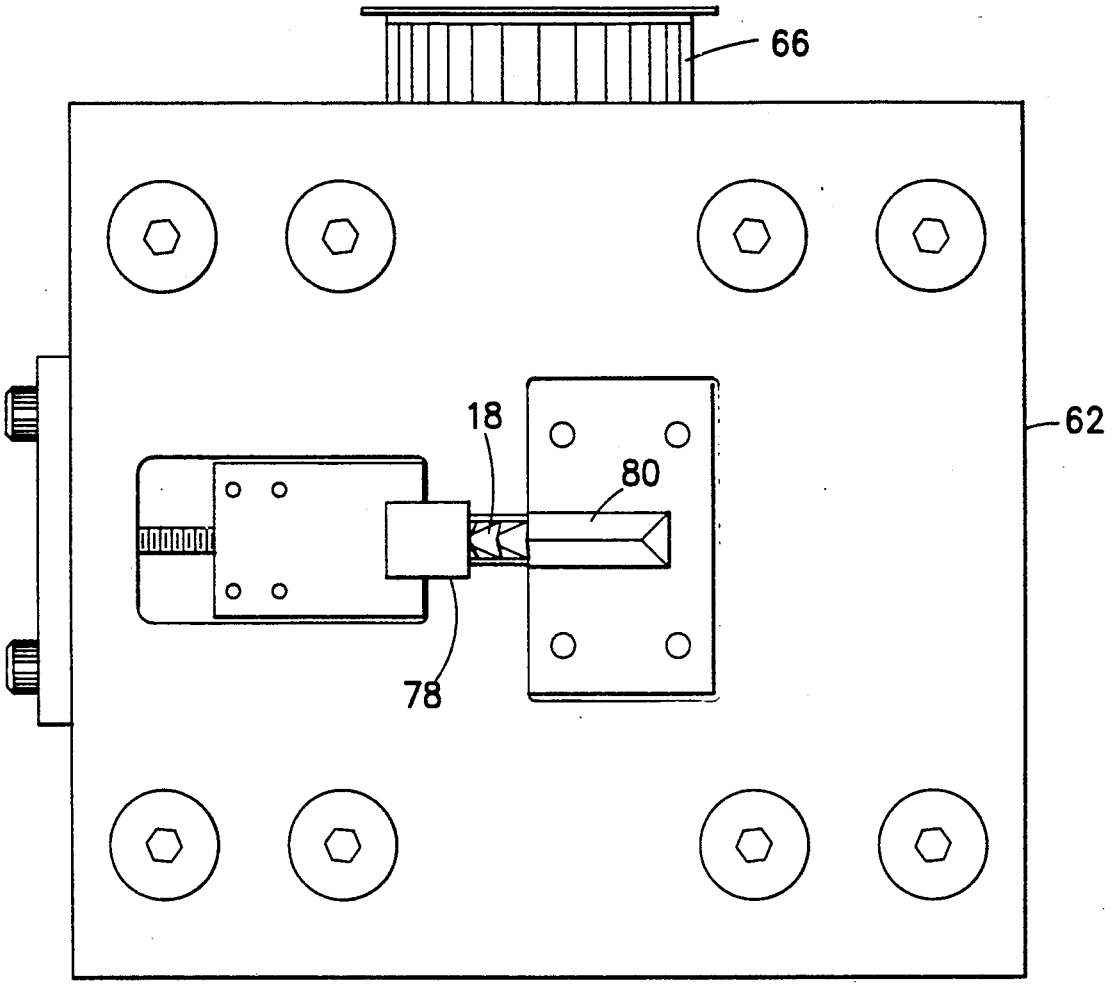
FIG. 5 is a bottom view of the cutter and cutter plate shown in FIG. 3.

Looking now to FIGS. 3 and 6 the cutting action will be explained. The blade 18 is rotating in the direction indicated and the cutting unit 56 is moving horizontally as indicated in FIG. 3. The support plate 62 has opening therein to allow the blades of the cutter to contact the top of the loops or fibers 74 to provide the lower configuration 76 in the cut area In the direction of movement of the cutting apparatus a ramp member 78 is mounted in the opening in bottom of the plate 62 to cause the loops 74 to be pushed over (FIG. 3) and then individually released so the blade 18 can cut the loop against the apex of the v-shaped cutting member 80 fixedly mounted in the bottom of the plate 62. This arrangement provides a more positive cutting of the fibers to provide better and longer lasting definition of the pattern in the surface of the carpet tile 16.

OPERATION

In use the carpet tile 16 to be sculptured is placed under the stylus 20 and the pattern or template 10 is placed under the stylus 15. Then the arrow 82 on the face of the transparent plastic member 84 in the stylus 15 is located in position over the pattern 12 in the template 10. It is understood that a pin or some other device can be used rather than the arrow 82 to trace the pattern 12 but the use of the arrow allows easier use of the device by the operator. The operator grasps the handle 85 mounted on the carrier 15 and using the arrow as a guide follows the pattern 12 to be cut into the tile 16. It should be noted that the carrier 20 moves 180° out of phase with the carrier 15 in equal and opposite directions while they both rotate simultaneously in the same direction.

It should be understood that the herein-disclosed pantograph arrangement is the preferred method of providing a means to sculpture the carpet tile 16 but other methods can be employed. It is conceivable that the herein-disclosed operation can be accomplished by robotics and the preferred pantograph operator can be basically eliminated but the pantograph has been proven to be reliable and provides the desired effect on the carpet tile to be sculptured. Also the described system as shown provides the same size design as on the template but size can be easily varied by varying the dimension of the apparatus transmitting the movement from the tracing stylus to the cutting stylus.

It can be seen that an arrangement has been described which will simply and efficiently sculpture a pile fabric in accordance with a predetermined design. Further, a new and novel pantograph arrangement has been described which provides a means to readily translate the desired sculpture design to the pile product to sculptured.

Although the preferred embodiment has been specifically described it is contemplated that changes may be made without departing from the scope or spirit of the invention and it is desired that the invention be limited only by the scope of the claims.

I claim;

1. Method to sculpture a predetermined pattern in the surface of a pile fabric comprising the steps of: supplying a pattern to be cut into a pile fabric, supplying a pile fabric with a surface to be cut, supplying a cutting apparatus adjacent the surface of the pile fabric, tracing the pattern to be cut and in response to the tracing simultaneously moving the cutting apparatus over the pile surface to be cut and cutting the pattern in the pile surface by bending over pile fibers in the area to be cut and then releasing the bent over pile fibers individually to allow the cutting apparatus to cut a top of the pile fibers thereof against a fixed cutting blade.

2. The method of claim 1 wherein a pantograph is employed to trace the pattern to be cut and simultaneously mova the cutting apparatus to sculpture the surface of the pile fabric.

3. Apparatus to sculpture the surface of a pile fabric comprising: a template to be traced, a cutting apparatus to cut the surface of a pile fabric, said cutting apparatus having a cutting blade with a cutting axis located in a position at an angle to the surface to be cut, said cutting apparatus having a bottom portion with an opening to allow the cutting blade to project thereof, said bottom having a sloped ramp on one side of said opening and a v-shaped member fixedly attached on a side opposite side sloped ramp to interact with said cutting blade and a means to trace said template and simultaneously move said cutting apparatus to cut said pile fabric surface in the configuration traced by said means.

4. The apparatus of claim 3 wherein said means includes a pantograph.

5. The apparatus of claim 4 wherein said pantograph includes a first carrier operably associated with said template and a second carrier operably associated with said cutting apparatus.

6. The apparatus of claim 5 wherein said first and second carriers are rotatably mounted.

7. The apparatus of claim 6 wherein said pantograph includes a means to cause said carriers to rotate in the same direction at the same time.

8. A cutting apparatus for pile fabrics comprising: a support plate, a slot in said support plate, means mounting a double-edged milling blade cutter having teeth to said support plate with a portion of the teeth of said cutter in said slot a ramp on the bottom of said support plate operably with one end of said slot and sloping away therefrom and a fixed v-shaped cutter member located diametrically opposite to said ramp on the bottom of said support plate.

* * * * *

UNITED STATES PATENT AND TRADEMARK OFFICE

CERTIFICATE OF CORRECTION

PATENT NO. : 5,016,328

DATED : May 21, 1991

INVENTOR(S) : Michael W. Gilpatrick

It is certified that error appears in the above-identified patent and that said Letters Patent is hereby corrected as shown below:

CLAIM 2, Column 3, line 18, delete "mova" and substitute —move—

CLAIM 3, Column 4, line 2, delete "side" and substitute —said—

Signed and Sealed this

Twenty-fifth Day of January, 1994

*Attest:*

*Attesting Officer*

BRUCE LEHMAN

*Commissioner of Patents and Trademarks*